United States Patent [19]

Watanabe

[11] 4,400,928

[45] Aug. 30, 1983

[54] PACKING PAPER SUPPLY APPARATUS FOR COIN PACKING MACHINE

[75] Inventor: Kenkichi Watanabe, Tokyo, Japan

[73] Assignee: Laurel Bank Machine Co., Ltd., Tokyo, Japan

[21] Appl. No.: 215,095

[22] Filed: Dec. 10, 1980

Related U.S. Application Data

[63] Continuation of Ser. No. 37,862, May 10, 1979, abandoned.

[30] Foreign Application Priority Data

May 11, 1978 [JP] Japan ..... 53-55963

[51] Int. Cl.[3] ..... B65B 41/12; B65B 57/00

[52] U.S. Cl. ..... 53/64; 53/77; 53/212; 53/168

[58] Field of Search ..... 53/64, 212, 77, 168; 493/38

[56] References Cited

U.S. PATENT DOCUMENTS

| | | | |
|---|---|---|---|
| Re. 27,987 | 4/1974 | Hatanaka et al. | 53/212 X |
| 2,733,849 | 2/1956 | Trenchard | 53/77 X |
| 4,138,834 | 2/1979 | Nobuhiro | 53/212 |
| 4,159,607 | 7/1979 | Uchida et al. | 53/64 |

FOREIGN PATENT DOCUMENTS 53-114077 9/1978 Japan .

*Primary Examiner*—James F. Coan

*Attorney, Agent, or Firm*—Fleit, Jacobson & Cohn

[57] ABSTRACT

A packing paper supply apparatus for use with a coin packing machine which packs several kinds of coins with packing paper supplied from the supply apparatus. This supply apparatus includes a carriage which is accommodated in the machine body and which is charged with several kinds of the packing paper for the kinds of coins to be packed. A corresponding number of stoppers such as pins or recesses are provided in the outer periphery of the carriage and are arranged to correspond to the kinds of the packing paper. Drive means including an electric motor and a power train of belt and pulley type is used to drive the carriage so that it may rotate. An actuating member such as a bail having its extending end provided with a hook or roller is resiliently biased into abutment contact with one of the stoppers and can be brought into and out of engagement with the selected stopper in a manual manner so that the packing paper selected may be held in its supply position. Electric control means is used to control the driving operation of the electric motor of the drive means so that the electric motor may be abruptly stopped to hold the selected packing paper in the supply position.

7 Claims, 4 Drawing Figures

PACKING PAPER SUPPLY APPARATUS FOR COIN PACKING MACHINE

This is a continuation of application Ser. No. 37,862 filed May 10, 1979 and now abandoned.

BACKGROUND OF THE INVENTION

1. Field of the Invention

The present invention relates to improvements in a packing paper supply apparatus for use with a coin packing machine, and contemplates to improve the safety of the operator of the coin packing machine, to simplify the construction of the packing paper supply apparatus thereby to reduce the production cost thereof and to facilitate the charging and replacing operations of packing paper.

2. Description of the Prior Art

As is well known in the art, a coin packing machine is equipped with a packing paper supply apparatus which includes a carriage to be accommodated in the coin packing machine. The carriage is chargeable in advance with a number of kinds of packing paper for the kinds of coins to be packed. When the packing paper, which is normally in the form of a roll is to be initially inserted or replaced, a front door of the coin packing machine is opened, and the carriage is turned by operating a coin kind setting dial so that the coin packing paper of the kind to be inserted or replaced is selectively brought into a supply position facing to the outside through the opened front door. When, therefore, the operator of the coin packing machine performs the replacing or charging operation of the packing paper, there arises a problem in safety because the coin packing machine is always in an energized condition during that operation. Since, more specifically, the aforementioned carriage is mechanically fixed in a selectively set position, the coin kind setting dial has to be operated each time the charging position is interchanged to release a fixing device, thus giving rise to a considerable disadvantage and inevitably complicating the construction.

SUMMARY OF THE INVENTION

It is therefore an object of the present invention to provide a packing paper supply apparatus for use with a coin packing machine, which apparatus is free from the drawbacks concomitant with the prior art.

Another object of the present invention is to provide a packing paper supply apparatus of the above type, in which the opening of the front door of the coin packing machine causes the electric power to be disconnected during the charging or replacing operation of packing paper so that the carriage carrying the packing paper can be manually turned in an easy manner.

Still another object of the present invention is to provide a packing paper supply apparatus of the above type, in which an actuating member is brought into resilient engagement with one of the stoppers without any use of a fixing device and at the same time an electric motor for driving the carriage is abruptly stopped by electric control means so that the packing paper selected may be set in its supply position.

A further object of the present invention is to provide a packing paper supply apparatus of the above type, in which the charging operation or the like of the packing paper can be performed safely and advantageously by manually turning the carriage in an easy manner without keeping the coin packing machine energized, while meeting the safety standards regulated under laws of countries requiring that the paper supply to the machine of such kind be blocked at the instant the door is opened with a view to protecting the users of the machine.

A further object of the present invention is to provide a packing paper supply apparatus of the above type, in which no means for releasing the carriage from its fixed condition is required so that the construction can be simplified.

According to a first aspect of the present invention, there is provided a packing paper supply apparatus for use with a coin packing machine, comprising: a carriage accommodated in the body of said coin packing machine and charged with a number of kinds of packing paper for the kinds of coins to be packed; a corresponding number of stoppers carried on said carriage and arranged to correspond to the number of kinds of packing paper; drive means for driving said carriage to rotate; an actuating member resiliently biased into abutment contact with one of said stoppers and adapted to be brought into and out of engagement with the one of said stoppers in a manual manner and in accordance with the rotation of said carriage so that the packing paper selected may be held in its supply position; and control means for controlling the driving operation of said drive means so that said drive means may be abruptly stopped to hold the selected packing paper in the supply position thereof.

According to a second aspect of the present invention, there is provided a packing paper supply apparatus as set forth in the above primary aspect, wherein said control means includes a coin kind setting dial adapted to be manually turned in accordance with the kind of the coins to be packed, and an electric circuit having a plurality of switches fixed to the body of said coin packing machine, a switch fixed to the body of said coin packing machine, such a number of contact members as corresponds to the number of kinds of the packing paper, said contact members being carried to rotate together with said carriage so as to establish connections between the first-named switches and the second-named switch, such a number of switches as corresponds to the number of first-named switches, the third-named switches being selectively turned on and off in accordance with the rotations of said coin kind setting dial, a relay switch adapted to be changed over so as to energize said drive means so that said carriage may be turned, while providing engagement and disengagement between said stoppers and said actuating member, until the desired packing paper reaches its supply position, and a relay adapted to be energized to change over said relay switch when any of the contacts of the first-named switches is connected with any of the contacts of the third-named switches as said coin kind setting dial is turned to set the desired kinds of the coins.

According to a third aspect of the present invention, there is provided a packing paper supply apparatus as set forth in the foregoing first aspect, wherein each of said stoppers includes a pin or recess provided in the outer periphery of said carriage, and wherein said actuating member includes a bail having its extending end provided with a hook or roller which is sized and positioned to engage with said pin or recess.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENTS

The present invention will be described in connection with the preferred embodiments thereof with reference to the accompanying drawings.

Figure 1:
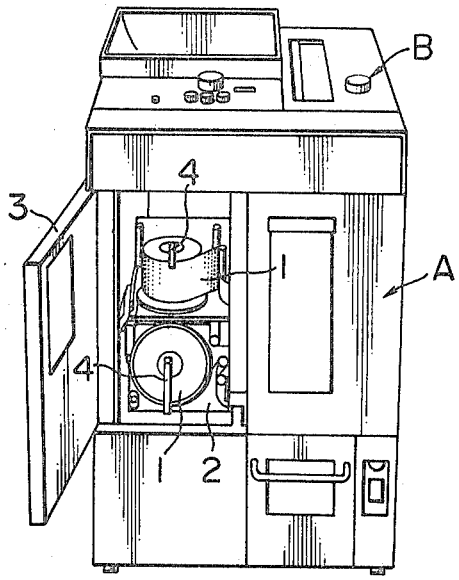
FIG. 1 is a perspective view of a coin packing machine and shows the arrangement of a packing paper supply apparatus with a front door being opened.

FIG. 1 is a perspective view showing the overall construction of a coin packing machine A, in which a carriage 2 charged with several kinds of packing paper 1 is accommodated. A door 3 shown in its open condition is used to provide easy access to the inside of the coin packing machine A when the packing paper 1 is to be inserted or replaced.

Figure 2:
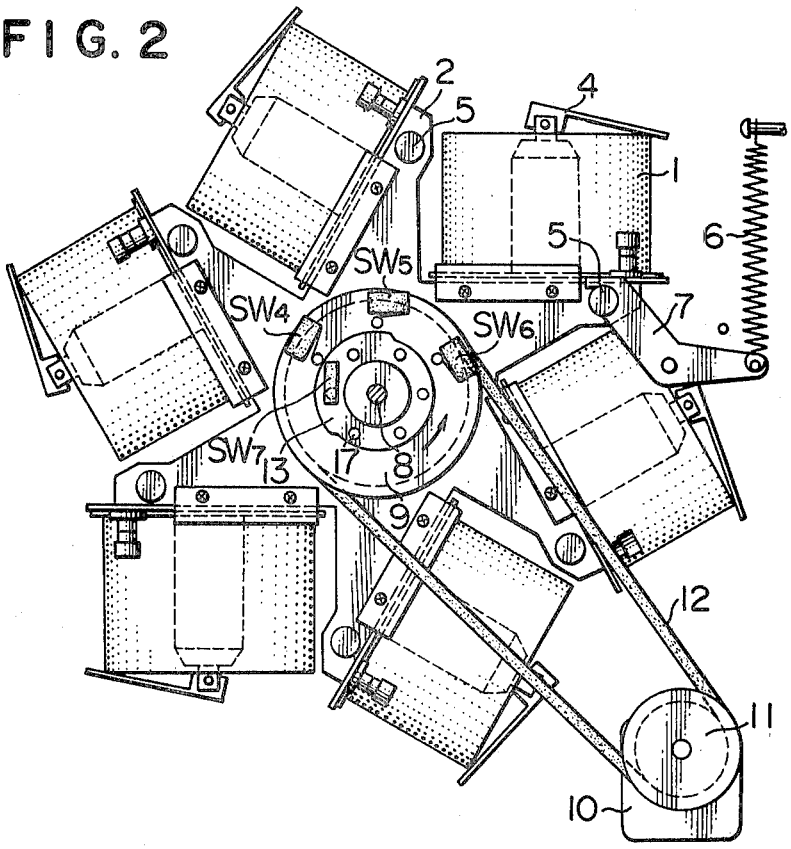
FIG. 2 is a front elevation showing the overall construction of the packing paper supply apparatus according to a first embodiment of the present invention.

The carriage 2 carries several kinds of the packing paper 1, each of which corresponds to a kind of coins to be packed and which is supported in a rolled shape upon a holder 4. For each kind of the packing paper 1, there is provided on the carriage 2 a stopper 5 which may be a pin, for example, as shown in FIG. 2. For each of these stoppers 5, moreover, there is provided at the side of the machine body an actuating member 7, e.g., in the form of a hook, which is resiliently supported by means of a coil spring 6.

The carriage 2 thus constructed is turned about a shaft 8 by means of a belt 12 which is made to run under tension between a pulley 9 fixed to the shaft 8 and a pulley 11 fixed to the shaft of a prime mover 10 such as an electric motor.

There is also fixed to the shaft 8 a cam 13 which carries such a number of contact members 17 as corresponds to the number of kinds of the packing paper 1. The cam 13 is arranged to face, for example, three switches $SW_4$, $SW_5$ and $SW_6$ which are fixed to the machine body. There is also provided at the machine side a switch $SW_7$ which is made coactive with those contact members 17.

Figure 3:
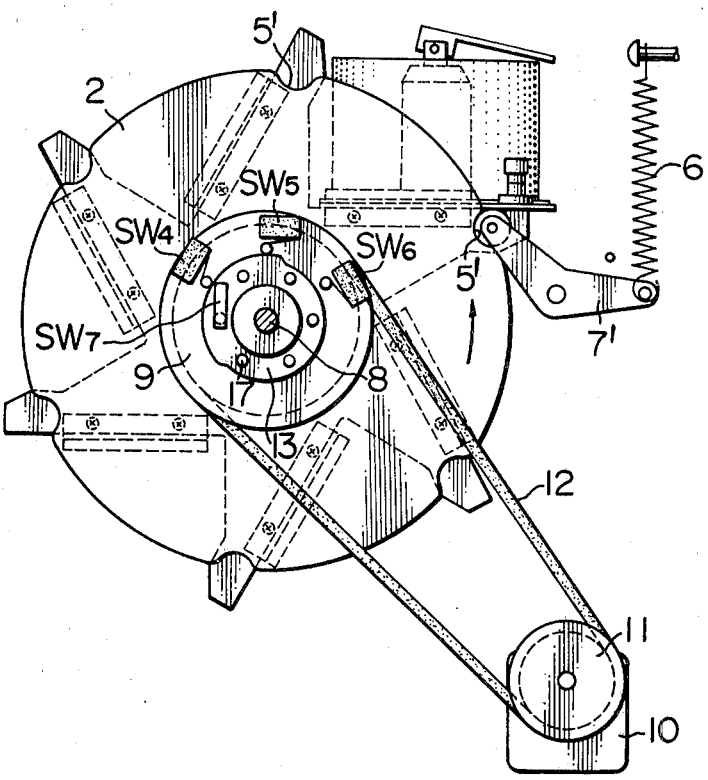
FIG. 3 is similar to FIG. 2 but shows another embodiment of the present invention.

Turning now to FIG. 3, there is shown another embodiment, in which stoppers 5' are modified to have a recessed form and in which actuating members 7' are modified to carry a roller. Other structures and operations are made similar to those of the first embodiment shown in FIG. 2.

In case it becomes necessary to replace one kind of the packing paper 1, the door 3 is opened, as shown in FIG. 1, to disconnect the power supply to the coin packing machine A. In this instance, if the packing paper 1 to be replaced is located inside, the carriage 2 is manually turned with considerable force in the direction of arrow of FIG. 2. Since, in this instance, no power is supplied, the prime mover 10 is set free, and in the manual turning operation can be performed without danger. This manual turning operation of the carriage 2 can be freely performed by extending the coil spring 6 under the hook of the actuating member 7 is disengaged from the corresponding actuating member 5. The turning operation is continued until the packing paper 1 to be replaced is brought to the position exposed to the outside through the door 3 opened. Thus, the desired packing paper 1 can be replaced, inserted or supplied in an easy, prompt and reliable manner.

In the second embodiment shown in FIG. 3, the roller of the actuating member 7' is made to roll out of the recess of the corresponding stopper 5' without any difficulty, as the turning operation of the carriage 2 proceeds, thus making the replacing, charging and supplying operations possible in a similar manner to first embodiment.

The operation for selecting a suitable paper corresponding to the selected coin kind will be now described.

Figure 4:
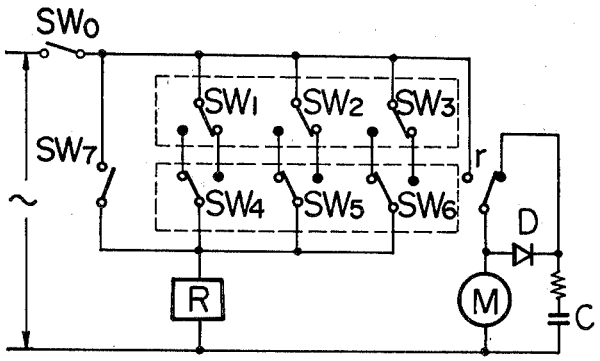
FIG. 4 is a connection diagram exemplifying electric control means of the packing paper supply apparatus.

The details of this operation are found in the disclosure of Japanese Unility Model Laid Open Publication No. 114077/78 of the same applicant. FIG. 4 shows switches $SW_1$, $SW_2$ and $SW_3$ which are selectively turned on and off by means of a cam (not shown) which is fixed to the shaft of a coin kind setting dial (not shown). This setting dial is attached to the coin packing machine A such that it can be turned in accordance with the kind of the coins to be packed. On the other hand, the switch $SW_7$ is turned on and off by means of the contact members 17. A relay R is used to operate a relay switch r such that this relay switch r is changed over between the side of the power source and the side of a capacitor C. When any of the contacts of the switches $SW_1$ to $SW_3$ is connected with any of the contacts of the switches $SW_4$ to $SW_6$ as the coin kind setting dial is turned to set the desired kind of coins, the relay R is energized to change over the relay switch r. As a result, a motor M is energized to start rotation so that the shaft 8, the cam 13 and the carriage 2 are turned in the direction of the arrow, while the stopper 5 or 5' alternately engages with or disengages from the actuating member 7 or 7', until the desired packing paper 1 reaches a position corresponding to the packing position. Then, all of the switches are turned off. As a result, the relay R returns the relay switch r to its original position at the side of the capacitor C. Then, there is made a circuit between the relay switch r and the capacitor C, which has been charged by DC power rectified by a diode D, so that the motor M is supplied with DC power and abruptly stopped. It should be noted that the switch $SW_7$ is operated by the contact members 17 in cooperation with the switches $SW_4$ to $SW_6$, thus facilitating the design and production of the cam 13.

As has been described hereinbefore, according to the present invention, the replacing, charging and supplying operations of the packing paper can be facilitated with increased safety while ensuring setting the packing paper in its proper supply position.

What is claimed is:

1. A packaging paper supply apparatus for use with a coin packaging machine having a body, comprising:
   - a carriage accomodated in the body of said coin packaging machine;
   - a plurality of holders supported by said carriage, said holders being charged with kinds of packaging paper corresponding to kinds of coins to be packaged;
   - a plurality of stoppers corresponding to the number of holders carried on said carriage;
   - drive means for driving said carriage to rotate;
   - a power supply connectable to said drive means;
   - an engaging member resiliently biased into abutment contact with one of said stoppers and adapted to be brought into and out of engagement with the one of said stoppers in accordance with the rotation of said carriage, said engaging member being disengaged from an engaged stopper upon rotation of said carriage by said drive means and upon manual rotation of said carriage;

a door provided on the body of said coin packaging machine, the door being opened to provide access to said carriage;

switch means for disconnecting said drive means from said power supply when said door is opened, so that said carriage is manually rotatable to move a selected holder from a position supplying packaging paper to a position receiving packaging paper, and for connecting said drive means to said power supply when said door is closed so that said carriage is rotated to return the selected holder to the supplying position; and control means for controlling connection of said power supply to said drive means so that said power supply, when disconnected from said drive means, abruptly stops said drive means to hold a selected one of said holders in the supplying position thereof, said control means comprising:

coin kind setting means for positioning one of said holders in the supplying position thereof, said setting means having a set switch associated with the supplying position of each of said holders;

a plurality of switches fixed with respect to said body, each of said plurality of switches being coactive with a respective one of said set switches to connect said power supply to said drive means;

a contact member associated with each of said holders, said contact members being rotatable with said carriage;

switch means fixed with respect to said body and coactive with said contact members and said plurality of switches for disconnecting said power supply from said drive means; and rectifier circuit means responsive to the disconnecting of said power supply from said drive means for supplying power to abruptly stop said drive means.

2. A packaging paper supply apparatus according to claim 1, wherein said drive means includes a first shaft rotatably supporting said carriage, a first pulley fixed to said first shaft, a prime mover having a second shaft and being adapted to be energized by said control means, a second pulley fixed to said second shaft, and a belt adapted to run under tension between said first and said second pulleys so that the driving force of said prime mover is transmitted to said carriage therethrough.

3. A packaging paper supply apparatus according to claim 1, further comprising a cam made rotatable together with said carriage and carrying said contact members.

4. A packaging paper supply apparatus according to claim 1, wherein each of said stoppers includes a recess formed in the outer periphery of said carriage.

5. A packaging paper supply apparatus according to claim 1, wherein each of said stoppers includes a pin anchored at the outer periphery of said carriage.

6. A packaging paper supply apparatus according to claim 5, wherein said engaging member includes a bail having its extending end formed with a hook which is sized and positioned to engage with said pin.

7. A packaging paper supply apparatus according to claim 4, wherein said engaging member includes a bail having its extending end carrying a roller which is sized and positioned to engage with said recess.

* * * * *